US006231635B1

(12) United States Patent
Suzuki et al.

(10) Patent No.: US 6,231,635 B1
(45) Date of Patent: May 15, 2001

(54) LUBRICANT POWDER FOR POWDER METALLURGY

(75) Inventors: Masaaki Suzuki, Tokyo; Toshio Serita, Kanagawa-ken; Norio Ukai, Kanagawa-ken; Hiroyasu Saitoh, Kanagawa-ken, all of (JP)

(73) Assignee: Höganäs AB, Hoganas (SE)

( * ) Notice: Subject to any disclaimer, the term of this patent is extended or adjusted under 35 U.S.C. 154(b) by 0 days.

(21) Appl. No.: 09/240,621

(22) Filed: Feb. 1, 1999

Related U.S. Application Data

(63) Continuation of application No. PCT/SE97/01327, filed on Aug. 5, 1997.

(30) Foreign Application Priority Data

Aug. 6, 1996 (JP) ..... 8-206692

(51) Int. Cl.[7] ..... C10M 101/04; C10M 105/68

(52) U.S. Cl. ..... 75/252; 508/528; 508/537; 508/554

(58) Field of Search ..... 75/252, 255; 508/528, 508/537, 554

(56) References Cited

U.S. PATENT DOCUMENTS 3,827,980 * 8/1974 Thompson et al. ..... 508/528
3,980,572 * 9/1976 Dodo et al. ..... 508/537
4,106,432 * 8/1978 Blachford ..... 75/252
5,256,185 * 10/1993 Semel et al. ..... 75/255
5,498,276 * 3/1996 Luk ..... 75/252
5,989,304 * 11/1999 Ozaki et al. ..... 75/252
6,001,150 * 12/1999 McCall et al. ..... 75/255

FOREIGN PATENT DOCUMENTS

54/117873 9/1979 (JP) .

OTHER PUBLICATIONS

"*Influence of Lubricants on Dimensional Changes and Mechanical Properties of Sintered Ferrous Compacts*" M. Ward, Powder Metallurgy, vol. 22, No. 4 (1979) pp. 193–200. [Abstract provided by STN International, File CAPLUS, CAPLUS Accession No. 1980:114330.]

* cited by examiner

*Primary Examiner*—George Wyszomierski
(74) *Attorney, Agent, or Firm*—Burns, Doane, Swecker & Mathis LLP

(57) ABSTRACT

The invention concerns a lubricant for powder metallurgical compositions containing 10–60% by weight of a lithium salt of a fatty acid; 0–40% by weight of a zinc salt of a fatty acid and 40–90% by weight of a fatty acid bis-amide. 10–60% by weight of the lubricant is made up by the lithium and the zinc salt.

7 Claims, No Drawings

LUBRICANT POWDER FOR POWDER METALLURGY

This is a continuation of International Application No. PCT/SE97/01327, filed Aug. 5, 1997, that designates the United States of America and which claims priority from Japanese Application No. 8/206692, filed Aug. 6, 1996.

The present invention relates to a lubricant for metallurgical powder compositions as well as a metal-powder composition containing the lubricant. The invention further concerns a method for making sintered products by using the lubricant.

The powder metallurgy industry has developed iron-based powder compositions that can be processed into integral metal parts having various shapes and sizes for uses in the automotive and electronics industries. One processing technique for producing the parts from the base powders is to charge the powder into the die cavity and compact the powder under high pressures. The resultant green part is then removed from the die cavity and sintered.

To avoid excessive wear on the die cavity, lubricants are commonly used during the compaction process. Lubrication is generally accomplished by either blending a solid lubricant powder with the iron-based powder (internal lubrication)or by spraying a liquid dispersion or solution of the lubricant onto the die cavity surface (external lubrication). In some cases both techniques are used. Almost all currently used lubricants are derived from naturally occurring long-chain fatty acids.

The most common, fatty acid it stearic acid ($C_{17}H_{35}COOH$) consisting of an aliphatic chain $CH_3.(CH_2)_{16}$ combined with the carboxylic acid group —COOH. When mixed with metal powders, it provides fast flow, high apparent density and good lubricity. Its low melting point (64° C.) car lead to softening during blending with the powder causing problems. Therefore, salts of stearic acid, i.e. metallic soaps are more popular. The major drawback of the soaps is their metal content. On burn-off, the fatty acid chain volatilizes readily but the metal remains behind as oxide or carbonate, although this may undergo reduction to the metal in a reducing atmosphere.

The most widely used metallic soap is zinc stearate because of its good flow properties. In reducing atmospheres, the zinc oxide remaining after initial decomposition is reduced to zinc, which readily volatilizes because of its low boiling point (907° C.). Unfortunately, on contacting the cooler parts of the furnace or the outside atmosphere, the zinc tends to condense, forming some zinc oxide as well. A consequence of this condensation is that the production has to be interrupted as the furnace has to be cleaned regularly.

The problems associated with metallic soaps can be avoided by the use of completely organic materials such as waxes. The one most widely used in powder metallurgy is ethylene-bisstearamide (e.g. Acrawax C). This material has a high melting point (140° C.) but it burns off at relatively low temperatures and leaves no metallic residue. The most serious disadvantage is its poor flow behaviour in metal powders.

Furthermore, mixtures of zinc salts of fatty acids and fatty acid bis-amides have not been accepted the P/M industry because of the poor performance of such mixtures.

It has now unexpectedly been found that a lubricant enabling the manufacture of compacted products having high green strength and high green density in combination with low ejecting force can be obtained with a lubricant comprising a lithium and optionally a zinc salt of one or more fatty acids and a fatty acid bisamide product. More specifically the amount of the metal salts of the fatty acids should constitute about 10–60% by weight of the lubricant according to the invention. The amount of the lithium salt is 10–60% by weight and the amount of the zinc salt is 0–40% by weight. Preferably the amount of the zinc salt is at least 10 and most preferably at least 15% by weight of the lubricant. The amount of the bisamide product is 40–60% by weight.

Typical examples of lithium salts of fatty acids are lithium laurate, lithium myristate, lithium palmitate, lithium stearate, lithium behenate, lithium montanate and lithium oleate which are lithium salts of fatty acids having 12~28 carbon atoms.

Typical examples of zinc salts of fatty acid are zinc laurate, zinc myristrate, zinc palmitate, zinc stearate, zinc behenate, zinc montanate and zinc oleate which are lithium salt of fatty acids 12~28 carbon atoms.

Typical examples of fatty acid bis-Amides are methylene bis-lauramide, methylene bis-myristamide, methylene bis-palmitamide, methylene bis-stearamide, ethylene bis-behenamide, methylene bis-oleamide, ethylene bis-lauramide, ethylene bis-myristamide, ethylene bis-palmitamide, ethylene bis-stearamide, ethylene bis-behenamide, ethylene bis-montanamide and ethylene bis-oleamide.

The lubricant is preferably prepared by mixing and melting the components and the obtained mixture is subsequently cooled and micronized to a suitable particle size.

The invention is further illustrated by the following non limiting examples.

EXAMPLES 1–5

5 different lubrication samples having the composition shown in the following Table 1 were prepared.

TABLE 1

| | Example No. | | | | |
|---|---|---|---|---|---|
| | 1 | 2 | 3 | 4 | 5 |
| Lithium stearate (% by weight) | 10 | 35 | 60 | 20 | 20 |
| Zinc stearat (% by weight) | 0 | 0 | 0 | 15 | 40 |
| Ethylenebis-stearic acid amide (% by weight) | 90 | 65 | 40 | 65 | 40 |

Atomized steel powders (10 kg) were mixed with the sample lubricants 1–5(80 g) and each powder mix was investigated as regards apparent density, green density (at 5 and 7 ton/cm$^2$), ejection force, green strength and sintered density. The sintering was carried out at 1120° C.×30 min. with base (?) atmosphere. The results are disclosed in table 2.

TABLE 2

| | | Example No. | | | | |
|---|---|---|---|---|---|---|
| | | 1 | 2 | 3 | 4 | 5 |
| Apparent density of raw material before compacting (g/cm$^3$) | | 3.16 | 3.20 | 3.25 | 3.25 | 3.25 |
| Ejection pressure of compact (kgf/cm$^2$) | Compacting pressure 5 ton/cm$^2$ | 102 | 105 | 106 | 104 | 106 |
| | Compacting pressure 7 ton/cm$^2$ | 117 | 114 | 120 | 115 | 121 |

TABLE 2-continued

| | | Example No. | | | | |
|---|---|---|---|---|---|---|
| | | 1 | 2 | 3 | 4 | 5 |
| Density of compact ($g/cm^3$) | Compacting pressure 5 $ton/cm^2$ | 6.95 | 6.96 | 6.95 | 6.95 | 6.94 |
| | Compacting pressure 7 $ton/cm^2$ | 7.14 | 7.10 | 7.11 | 7.14 | 7.10 |
| Strength of compact ($kgf/cm^2$) | Compacting pressure 5 $ton/cm^2$ | 131 | 135 | 130 | 137 | 130 |
| | Compacting pressure 7 $ton/cm^2$ | 181 | 188 | 182 | 192 | 183 |
| Density of sintered compact ($g/cm^3$) | Compacting pressure 5 $ton/cm^2$ | 6.94 | 6.95 | 6.93 | 6.96 | 6.95 |
| | Compacting pressure 7 $ton/cm^2$ | 7.14 | 7.11 | 7.11 | 7.13 | 7.10 |

Subsequently 5 different lubrication samples (comparative examples 1–5) having the compositions shown in the following Table 3 were prepared for comparison.

TABLE 3

| | Comparative example No. | | | | |
|---|---|---|---|---|---|
| | 1 | 2 | 3 | 4 | 5 |
| Lithium stearate (% by weight) | 100 | 0 | 0 | 65 | 0 |
| Zinc stearat (% by weight) | 0 | 100 | 0 | 35 | 35 |
| Ethylenebis-stearic acid amide (% by weight) | 0 | 0 | 100 | 0 | 65 |

These samples were tested in the same way as above and the results are shown in table 4.

TABLE 4

| | | Comparative example No. | | | | |
|---|---|---|---|---|---|---|
| | | 1 | 2 | 3 | 4 | 5 |
| Apparent density of raw material before compacting ($g/cm^3$) | | 3.44 | 3.22 | 3.02 | 3.09 | 3.35 |
| Ejection pressure of compact ($kgf/cm^2$) | Compacting pressure 5 $ton/cm^2$ | 128 | 125 | 118 | 127 | 118 |
| | Compacting pressure 7 $ton/cm^2$ | 141 | 140 | 134 | 145 | 135 |
| Density of compact ($g/cm^3$) | Compacting pressure 5 $ton/cm^2$ | 6.88 | 6.85 | 6.77 | 6.81 | 6.87 |
| | Compacting pressure 7 $ton/cm^2$ | 7.01 | 6.99 | 6.88 | 6.95 | 6.98 |
| Strength of compact ($kgf/cm^2$) | Compacting pressure 5 $ton/cm^2$ | 109 | 105 | 119 | 106 | 120 |
| | Compacting pressure 7 $ton/cm^2$ | 146 | 149 | 162 | 150 | 161 |
| Density of sintered compact ($g/cm^3$) | Compacting pressure 5 $ton/cm^2$ | 6.87 | 6.86 | 6.79 | 6.83 | 6.86 |
| | Compacting pressure 7 $ton/cm^2$ | 6.99 | 6.98 | 6.88 | 6.96 | 6.98 |

EXAMPLE 6

The lubricant used in the production of green compacts by sintering in a large-size sintering furnace (production amount about 200 ton/month) and a medium-size sintering furnace (production amount about 100 ton/month) was changed from zinc stearate which had been used for many years (Comparative example 6) into a powder lubricant prepared with the weight ratios shown in Table 5 (Example 6). As the result, when the inside of the furnace had been periodically cleaned at the frequency of three times a year when using zinc stearate, the furnaces had not been stopped for cleaning of accumulated matter even after 1.5 years had passed after the change of the lubricant, and no remarkable accumulated matter was noted even after that.

TABLE 5

| Chemical Component | Example No. 6 | Comparative Example No. 6 |
|---|---|---|
| Lithium stearate (% by weight) | 20 | 0 |
| Zinc stearate (% by weight) | 15 | 100 |
| Ethylenebis-stearic acid amide (% by weight) | 65 | 0 |

Effect of the Invention

As is apparent fro the Examples 1–6, this invention can provide a powder lubricant for powder metallurgy that can achieve a high bulk density when a metal powder is packed into a metal mould, a low ejection pressure from the metal mould, an improved density and strength of the formed compact, an improved density of the sintered compact, with no contamination of the sintering furnace.

What is claimed is:

1. Lubricant for powder metallurgical compositions containing

10–60% by weight of a lithium salt of a fatty acid;

10–40% by weight of a zinc salt of a fatty acid and

40–80% by weight of a fatty acid bis-amide selected from the group consisting of methylene bis-lauramide, methylene bis-myristamide, methylene bis-palmitamide, methylene bis-stearamide, ethylene bis-behenamide, methylene bis-oleamide, ethylene bis-lauramide, ethylene bis-myristamide, ethylene bis-palmitamide, ethylene bis-stearamide, ethylene bis-behenamide, ethylene bis-montanamide and ethylene bis-oleamide, wherein 20–60% by weight of the lubricant is made up by the lithium and the zinc salt, and wherein said lubricant is in the form of a molten, micronized powder.

2. Lubricant according to claim 1 wherein the fatty acid is selected from the group consisting of saturated or non-saturated fatty acids having 12–28 carbon atoms.

3. Lubricant according to claim 2 wherein the fatty acid bis-amide is ethylene bis-stearamide.

4. A metal-powder composition containing an iron-based powder and a lubricant according to claim 1.

5. A metal-powder composition containing an iron-based powder and a lubricant according to claim 2.

6. A metal-powder composition containing an iron-based powder and a lubricant according to claim 3.

7. A metal-powder composition containing an iron-based powder and a lubricant according to claim 1.

* * * * *